US007686895B2

(12) United States Patent
Hattiangadi et al.

(10) Patent No.: US 7,686,895 B2
(45) Date of Patent: Mar. 30, 2010

(54) METHOD OF IMPROVING MECHANICAL PROPERTIES OF GRAY IRON

(75) Inventors: Ashwin A. Hattiangadi, Dunlap, IL (US); Adrian Vasile Catalina, Metamora, IL (US); Leo Chuzhoy, Oswego, IL (US); Jun Cai, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 445 days.

(21) Appl. No.: 11/701,145

(22) Filed: Jan. 31, 2007

(65) Prior Publication Data

US 2008/0178971 A1 Jul. 31, 2008

(51) Int. Cl.
*C21D 5/02* (2006.01)
*C21D 1/04* (2006.01)

(52) U.S. Cl. ..... 148/108; 148/103; 148/565; 148/612

(58) Field of Classification Search ..... 420/9–33; 148/321–324, 612, 103, 108, 565
See application file for complete search history.

(56) References Cited

U.S. PATENT DOCUMENTS

| | | | | |
|---|---|---|---|---|
| 5,466,304 | A | 11/1995 | Kogiku et al. | |
| 5,885,370 | A | 3/1999 | Shimotomai et al. | |
| 6,375,760 | B2 | 4/2002 | Maruta et al. | |
| 6,773,513 | B2 | 8/2004 | Ludtka | |
| 7,063,752 | B2 * | 6/2006 | Koo et al. | 148/108 |
| 7,161,124 | B2 * | 1/2007 | Kisner et al. | 219/635 |
| 2005/0077289 | A1 | 4/2005 | Christofis et al. | |

FOREIGN PATENT DOCUMENTS

| | | | |
|---|---|---|---|
| CN | 1575889 | | 2/2005 |
| JP | 52-111412 | | 9/1977 |
| JP | 407018368 | * | 1/1995 |
| JP | 410298643 | * | 11/1998 |
| JP | 2000-328143 | | 11/2000 |
| JP | 2005105359 | * | 4/2005 |
| SU | 427070 | | 5/1974 |

OTHER PUBLICATIONS

Derwent publication of English abstract of Chinese patent 1575889, Feb. 9, 2005, Li et al.*
Machine-English translation of Japanese patent 410298643, Takashi Iwamoto, Nov. 10, 1998.*
Davis et al., "Cast Irons. Heat Treating of Gray Irons," XP002479447A, ASM International, The Materials Information Society, Sep. 1996, pp. 179-191.
Wu Cun-You et al., "Ferrite transformation in spheroidal graphite cast iron under a high magnetic field." XP19210163A, vol. 39, No. 3, Feb. 1, 2004, pp. 1129-1130.

* cited by examiner

*Primary Examiner*—Deborah Yee
(74) *Attorney, Agent, or Firm*—Leydig, Voit & Mayer, Ltd

(57) ABSTRACT

A method of forming gray iron components includes applying a substantially uniform magnetic field to gray iron. The method also includes heat-treating the gray iron while the gray iron is within the magnetic field.

12 Claims, 5 Drawing Sheets

METHOD OF IMPROVING MECHANICAL PROPERTIES OF GRAY IRON

TECHNICAL FIELD

The present disclosure relates generally to a method for improving the strength and durability of gray iron, and more particularly, to a method of magnetic heat treatment of gray iron.

BACKGROUND

Gray iron is a group of ferrous alloys that contain a relatively large percentage of carbon in the form of flake graphite. Gray iron generally contains more than 95% iron element, while the main alloying elements are carbon and silicon. The amount of carbon in gray iron typically is in the range of 2.1%-4%. Gray iron is relatively easy and inexpensive to make. Compared to the more modern engineered irons, gray iron has a lower tensile strength and lower ductility. In other words, it may fail more easily, and its mode of failure may be by sudden fracture. Gray iron is used for engine components where tensile strength is not critical, for example, engine blocks, engine cylinder heads, engine liners, pump housings, and valve bodies. There are several advantages to using gray iron to make certain engine components. For example, gray iron transfers heat more quickly and easily than steel. Also, gray iron has noise damping characters that result in lower engine noise.

It is expected that a stricter environment regulation be enforced in the future, which demands lower exhaust emissions from internal combustion engines. One way to achieve this is to increase combustion temperatures and pressures in internal combustion engines. This may require that the engine components made from gray iron have increased strength and hardness. As a result, there is a desire for a new method to improve the tensile strength and hardness of engine components made from gray iron.

It has been known that mechanical properties of a material are a function of the material's microstructure, and that such properties may be controlled by chemistry and physical processing. For example, one method of enhancing the tensile strength of steel is described in U.S. Pat. No. 5,885,370 (the '370 patent) issued to Shimotomai et al. The '370 patent describes a method of providing magnetic heat treatment to steel to refine the microstructure and improve the mechanical properties of the steel.

While the method of the '370 patent may be effective for improving mechanical properties of steel, the method of the '370 patent includes several disadvantages. For example, according to the disclosure of the '370 patent, the method may only be effective on steel with a carbon percentage limited to a range of 0.01% to 2% by mass. Thus, the disclosed method may not be applicable to gray iron that typically has a carbon percentage in a range of 2.1% to 4% by mass. In addition, the method disclosed in the '370 patent requires applying a magnetic field having a gradient limited to a particular range. Maintaining a magnetic field within this particular range can be complicated and/or expensive.

The disclosed method is directed to overcoming one or more of the problems set forth above.

SUMMARY OF THE INVENTION

In one aspect, the present disclosure is directed to a method of forming gray iron components. The method may include applying a substantially uniform magnetic field to gray iron.

The method may further include heat-treating the gray iron while the gray iron is within the magnetic field.

In another aspect, the present disclosure is directed to a method of forming a gray iron component. The method may include heating gray iron to a first temperature of between about 800° C. to 900° C., applying a substantially uniform magnetic field to the gray iron, and annealing the gray iron while the gray iron is within the magnetic field. The annealing process may include cooling the gray iron to a second temperature of between about 500° C. to 650° C. The method may further include quenching the gray iron w while the gray iron is within the magnetic field.

In yet another aspect, the present disclosure is directed to an engine. The engine may include an engine component made from gray iron. The gray iron may have a pearlite spacing of about 0.05 microns to 0.1 microns

DETAILED DESCRIPTION

Experiments show that the microstructure of a ferrous material may be determined by phase transformations that occur when the material is cooled from a high temperature to a low temperature. Applying a magnetic field may facilitate such transformation, and thereby change the microstructure of the ferrous material. In particular, for gray iron, under a heat treatment in an ultra-high magnetic field, the nano-crystalline pearlite lamellar spacing may be changed. Thus, the mechanical properties of gray iron may be effectively changed.

Gray iron containing about 2.1% to 4% by mass of carbon may be used to form a component or a part of an engine. The component may be initially formed with a conventional metalworking process such as sand casting. After the gray iron component is formed, the component may be heat-treated. Heat treatment provides an efficient way to manipulate the properties of the metal by controlling the cooling process. The heat treatment process may include annealing and/or quenching. Annealing is a process that produces equilibrium conditions by heating and maintaining at a suitable temperature, and then cooling very slowly. It is used to relieve internal stresses, refine the structure and improve mechanical properties of the metal. Quenching is a process in which the gray iron component may be heated to a high temperature and then quickly cooled to improve the hardness of the component.

According to the present disclosure, in one embodiment, superconducting magnets may be used to generate a magnetic field within which the gray iron component may be heat-treated. Superconducting magnets typically are electromagnets that are partially made from superconducting materials, such as niobium-titanium. With such superconducting material, the magnets can reach an ultra-high magnetic field intensity. Superconducting magnets can produce a substantially uniform magnetic field with essentially no energy consumption after being charged to a predetermined field strength. Superconducting magnets are now commercially available.

Figure 1:
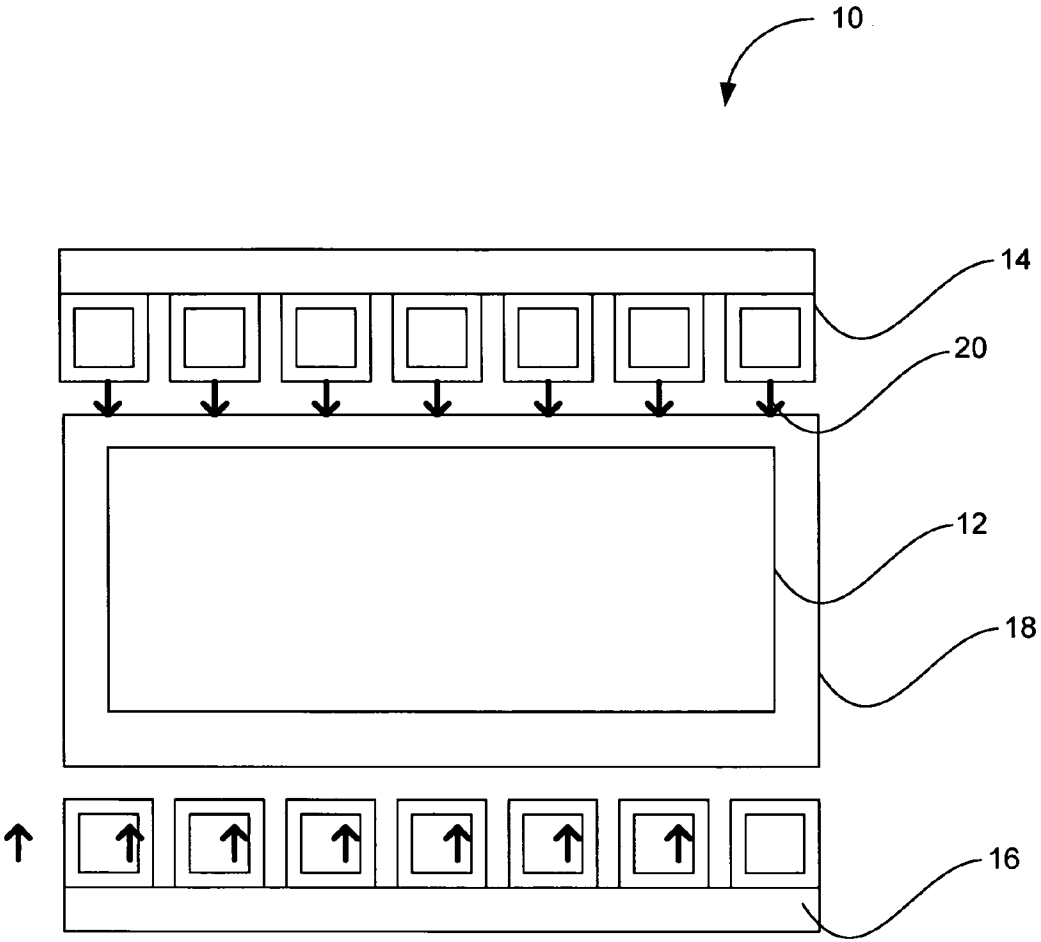
FIG. 1 illustrates an exemplary heat treatment device according to one exemplary embodiment of the present disclosure.

As shown in FIG. 1, a system 10 for magnetic heat treatment of a gray iron component 12 may include a furnace 18, in which gray iron component 12 may be heated. System 10 may further include two or more superconducting magnets 14 and 16 disposed opposite to each other. The superconducting magnets 14 and 16 may be configured and constructed to generate a substantially uniform magnetic field 20. In one embodiment, the superconducting magnets 14 and 16 may generate an ultra-high magnetic field 20 having a density in a range of about 7 Tesla (T) to 30 T. A person skilled in the art should appreciate that devices other than superconducting magnets 14 and 16 may be used to generate the ultra-high magnetic field 20. Gray iron component 12 may be heat-treated in the magnetic field 20 generated by the superconducting magnets 14 and 16.

In the heat-treatment process, the gray iron component 12 may be heated up in furnace 18 to a first predetermined temperature, and then cooled down by an annealing process, a quenching process, or a combination of both. In one exemplary embodiment, the gray iron component 12 may be heated in furnace 18 between about 800° C. to 900° C., for example, about 900° C., and then, within the magnetic field 20, the gray iron component 12 may be gradually cooled down to a second predetermined temperature between 500° C. to 650° C., for example, about 650° C. The duration of the annealing process may be from minutes to hours, for example, about two hours. Still within the magnetic field 20, the gray iron component 12 may next be quenched. In the quenching process, the gray iron component 12 may be rapidly cooled to a third predetermined temperature, for example, a room temperature (about 20° C. to 30° C.). As a result of the heat treatment process, the microstructure of the gray iron component 12 may transform from austenite to pearlite, with a relatively small pearlite lamellar spacing.

In another exemplary embodiment, a part of or the entire heat treatment process within the magnetic field 20 may be repeated one or more times. For example, the gray iron component 12 may be repeatedly heated and cooled. In one embodiment, the gray iron component 12 may be heated to about 900° C., then cooled down to about 650° C., and reheated to about 900° C., then cooled down again to about 650° C. Next, the gray iron component 12 may be quenched to room temperature. In another embodiment, the gray iron component 12 may be heated to about 900° C., then cooled down to about 650° C., and then quenched to room temperature. The gray iron component 12 may then be reheated to about 900° C., then cooled down again to about 650° C., and then quenched to room temperature. A person skilled in the art should appreciate that other combinations of the processes may also be used. The repeated process may provide more grain refinement in the gray iron 12, and thus improve the mechanical properties, for example, strength of the gray iron component 12. In some exemplary embodiments, the magnetic field may be applied to gray iron 12 during the entire heat treatment process. In some other embodiments, the magnetic field may be applied only one of, or less than all of, the heat treatment steps.

Material thermodynamics is not only a function of alloys and temperature, but also a function of electromagnetic field. Under ultra-high electromagnetic field, gray cast iron eutectoid temperature is expected to decrease. In some exemplary embodiments, one or more steps of the entire heat treatment process within the magnetic field may be repeated one or more times by switching magnetic field on and off. For example, the gray iron component 12 may be heated to about 900° C., then slowly cooled down to about 650° C. When the magnetic field is turned on, the microstructure of the gray iron component 12 may become unstable, and may transform from pearlitic microstructure to austenite. When the magnetic field is turned off, the microstructure of the gray iron component 12 may transform from the resulting austenite to pearlitic microstructure. By switching magnetic field on and off in a given frequency, a sharp flake tip may be rounded during the process to achieve a much improved gray iron fatigue strength. In the last "ON" state of electric magnetic field, the gray iron component 12 may be quenched to a room temperature. A person skilled in the art should appreciate that other combinations of the processes may also be used by just switching magnitude field on and off. The repeated process may provide more grain refinement and round graphite flake tip in the gray iron component 12, and thus improve the mechanical properties, for example, strength of the gray iron component 12.

Figure 2:
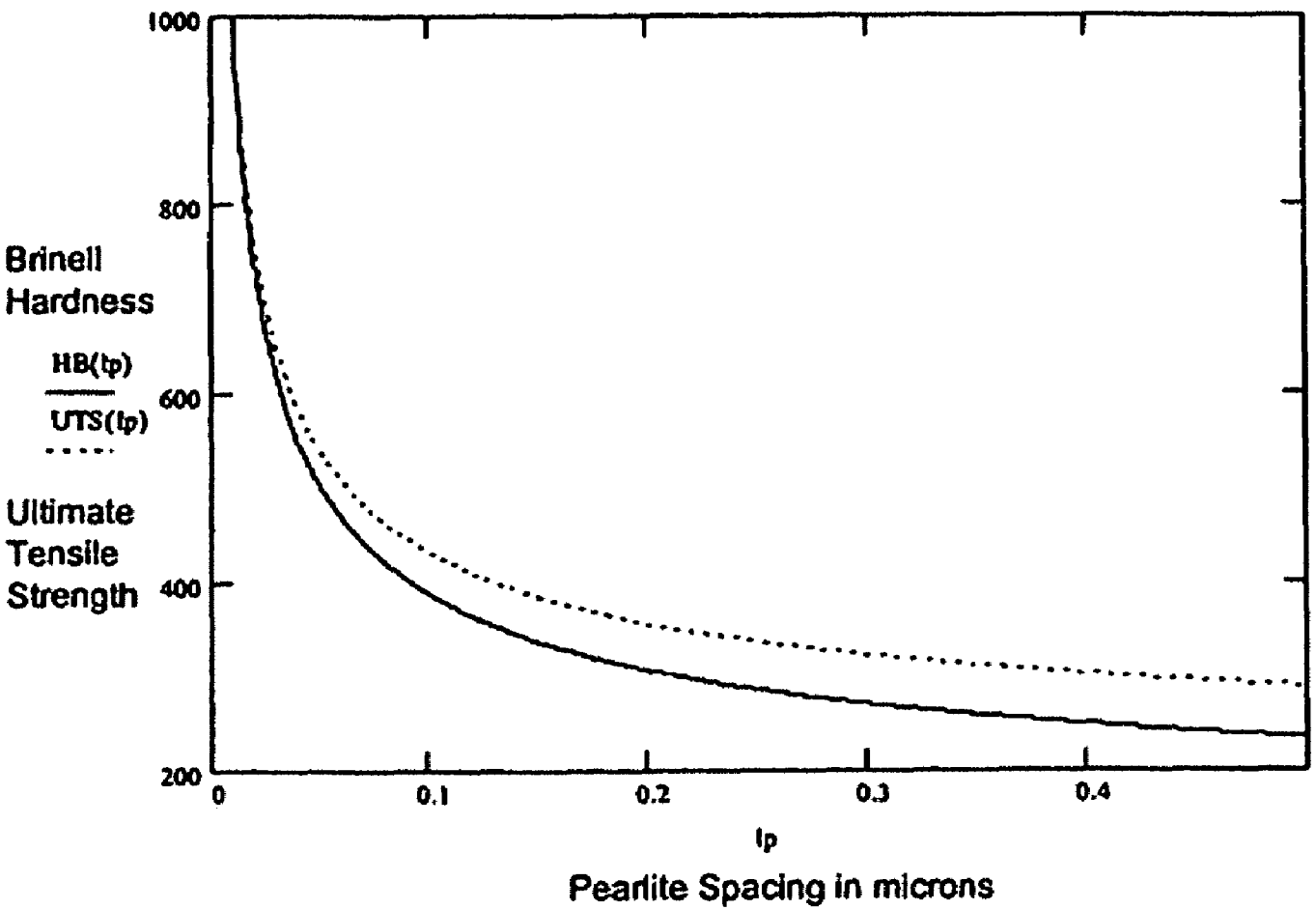
FIG. 2 is a chart showing the relationship between pearlite spacing of gray iron and Brinell Hardness and ultimate tensile strength of the material.

FIG. 2 is a chart showing the relationship between the pearlite spacing in microns of gray iron to Brinell hardness scale and ultimate tensile strength of gray iron based on experimental results. As shown in FIG. 2, the Brinell hardness (shown as a solid line) and the ultimate tensile strength (shown as a dashed line) are substantially inversely proportional to the pearlite spacing in gray iron. In an exemplary embodiment of the present disclosure, the pearlite spacing may be decreased by applying the ultra-high magnetic field 20 to the gray iron component 12 when the gray iron component 12 is heat-treated, and, the Brinell hardness and the ultimate tensile strength of the gray iron component may be increased accordingly.

The Brinell hardness of pearlite can be expressed as a function of the pearlite spacing $$HB(lp) = A + \frac{B}{\sqrt{lp}},$$

where HB is the Brinell hardness, lp is the pearlite spacing in microns, A and B are constants that can be evaluated experimentally.

Based on experiments:

$$HB(lp) = 110 + \frac{87.4}{\sqrt{lp}} \tag{1}$$

where the numbers 110 and 87.4 are constants evaluated by experiments.

For gray iron, the tensile strength is influenced both by the morphology of the graphite and pearlite spacing. The following equation is to determine the tensile strength:

$$UTS(lp) = 80 + \frac{2.25}{\sqrt{lg}} + \frac{1.98}{\sqrt{lg \cdot lp}} \tag{2}$$

where UTS is the ultimate tensile strength in MPa, lg is graphite length in microns, lp is pearlite spacing in microns, the numbers 80, 2.25, and 1.98 are coefficients determined based on experiments.

Typically, the graphite length "lg" of gray iron is about 500 microns. The pearlite spacing "lp" of gray iron is about 0.4 microns after being processed under a conventional heat treatment process without disposing gray iron in a magnetic field during the heat treatment. When the pearlite spacing is around 0.4 microns, according to the equations (1) and (2), the corresponding Brinell Hardness and the ultimate tensile strength are:

$$HB(0.4)=248$$

$$UTS(0.4)=302 \text{ MPa}$$

According to one experimental example, when the gray iron component 12 is heat-treated in the ultra-high magnetic field 20, for example, having a density in a range of about 7 Tesla (T) to 30 T, the pearlite spacing lp of the gray iron component 12 may be decreased from about 0.4 microns to about 0.1 microns. The Brinell hardness and the ultimate tensile strength may be increased according to the equations (1) and (2) to:

$$HB(0.1)=386$$

$$UTS(0.1)=431 \text{ MPa}$$

If the gray iron is heat-treated in an ultra-high magnetic field to decrease the pearlite spacing lp to about 0.05 microns, the Brinell hardness and the ultimate tensile strength are increased, respectively, to the following values according to the equations (1) and (2):

$$HB(0.05)=501$$

$$UTS(0.05)=537 \text{ MPa}$$

Compared with gray iron processed with conventional methods having a pearlite spacing of about 0.4 microns, the Brinell hardness and the ultimate tensile strength in the gray iron component 12, which has been heat-treated in the ultra-high magnetic field 20 and which has a pearlite spacing of about 0.05 microns to 0.1 microns, may increase about 42% to 79% and 55% to 100%, respectively.

Figure 3:
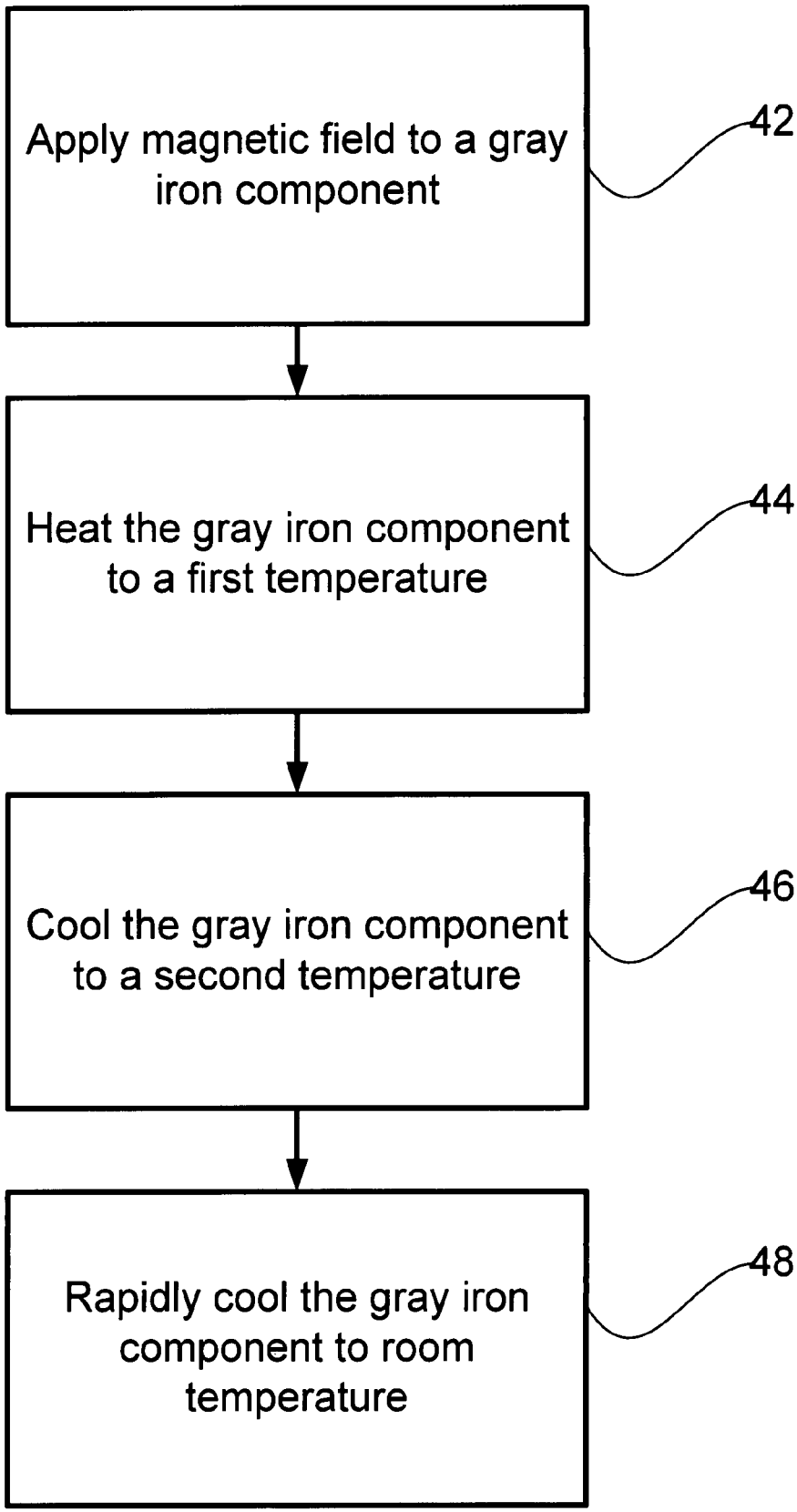
FIG. 3 is a flow chart illustrating an exemplary disclosed method.
Figure 4:
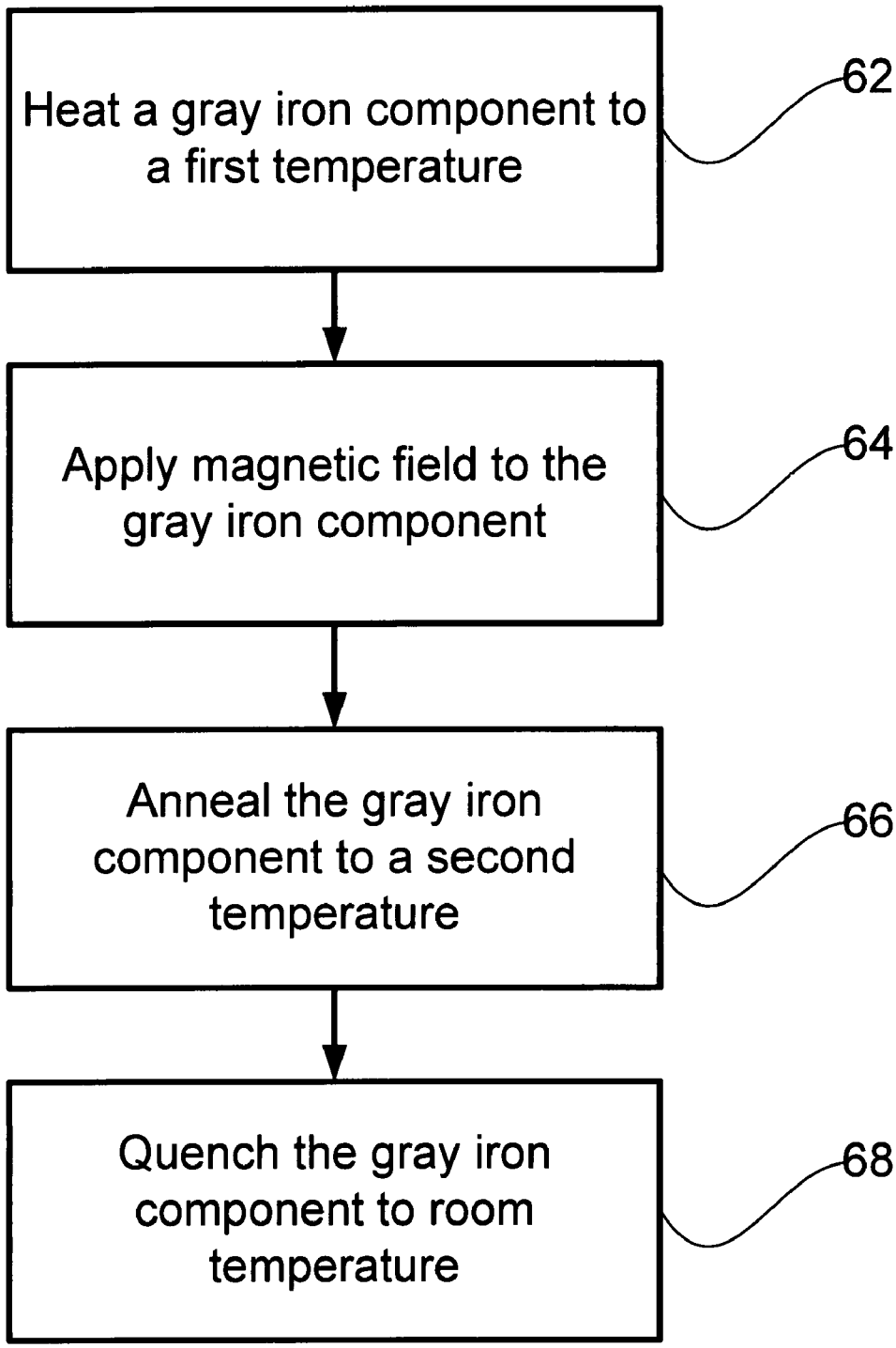
FIG. 4 is a flow chart illustrating another exemplary disclosed method.
Figure 5:
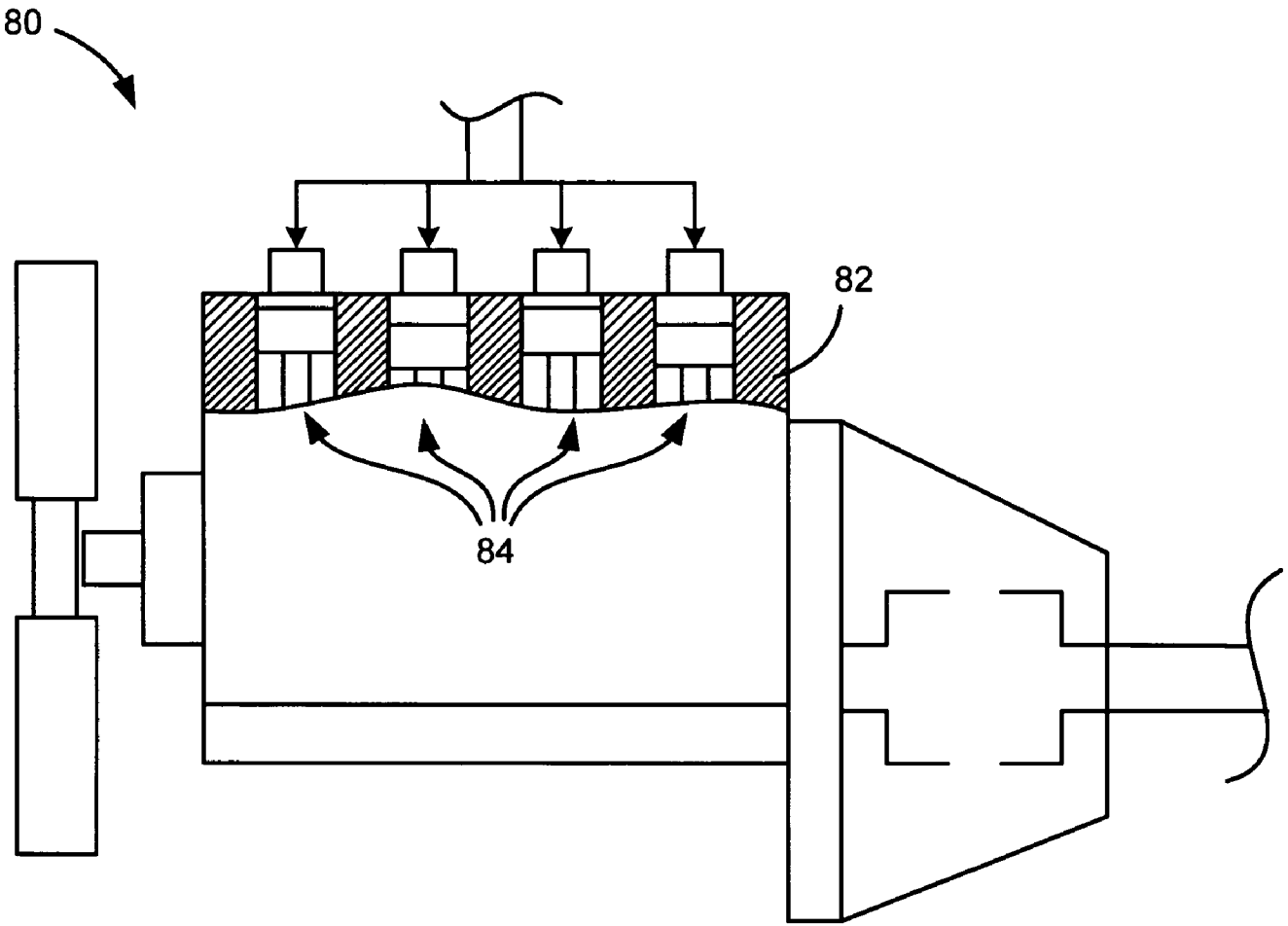
FIG. 5 schematically shows an engine system with a component processed by the exemplary disclosed method.

As will be described in more detail below, FIGS. 3 and 4 are flow charts illustrating exemplary disclosed methods for processing the gray iron component 12 according to the present disclosure. FIG. 5 illustrates an engine system 80 having an engine block 82 that may define a plurality of cylinders 84. The engine block 82 may be made from gray iron that has been heat-treated with a magnetic field according to the present disclosure. The engine block 82 may possess improved tensile strength and hardness according to the present disclosure. Gray iron may be used for other engine components such as engine heads, pump housings, valve bodies, etc.

INDUSTRIAL APPLICABILITY

The disclosed method may be applicable to any devices or components made from gray iron. The disclosed method may improve strength and other mechanical characteristics of gray iron components by applying an ultra-high magnetic field to the gray iron components during heat treatment of the gray iron components. The operation of the disclosed method will now be explained.

In one exemplary embodiment, the disclosure provides a method as shown in FIG. 3 for improving tensile strength and hardness of a gray iron component 12. The method may include applying a substantially uniform magnetic field 20 to gray iron component 12 (step 42). The substantially uniform magnetic field 20 may have a density of about 7 T. In one exemplary embodiment, the magnetic field 20 may be generated by superconducting magnets 14 and 16. The gray iron component 12 may then be heat-treated while the gray iron component 12 is within the magnetic field 20. The heat treatment may include annealing and quenching. The annealing process may include heating the gray iron component 12 in furnace 18 to a first temperature of about 800° C. to 900° C., for example, about 900° C. (step 44), and cooling the gray iron component 12 gradually to a second temperature of about 500° C. to 650° C., for example, about 650° C. (step 46). The gray iron component 12 may then be quenched, rapidly cooled to a room temperature, which is about 20° C. to 30° C., for example, 25° C. (step 48). The magnetic filed may be applied to the gray iron component 12 for the whole heat treatment process, which may be minutes to hours, depending on the size, shape, or other characteristics of the component, and the cooling rate of the annealing process. The annealing process and/or the quenching process may be repeated one or more times. Thus the gray iron component 12 may be treated within the magnetic field 20 to provide more grain refinement to further improve its mechanical properties, for example, its strength.

FIG. 4 illustrates another exemplary method of improving mechanical properties of gray iron according to the present disclosure. At step 62, gray iron component 12 may be heated to a first temperature of about 800° C. to 900° C., for example, 900° C. It should be understood by a person skilled in the art that the gray iron component 12 may be formed at a high temperature, for example by a forging process, and that should be considered equivalent to heating the gray iron component to a high temperature (e.g., about 800° C. to 900° C.). Alternatively, the gray iron component 12 may be formed at a temperature higher than the range of 800° C. to 900° C., and may be cooled down to a temperature in such a range. At step 64, a substantially uniform magnetic field 20 may be applied to the gray iron component 12. The substantially uniform magnetic field 20 may have a density of about 7T to 30 T. The magnetic field 20 may be generated by superconducting magnets 14 and 16. The gray iron component 12 may then be annealed. In the annealing process, the gray iron component 12 may be gradually cooled from the first temperature to a second temperature of about 500° C. to 650° C., for example, about 650° C. (step 66). The gray iron component 12 may then be quenched, rapidly cooled to a room temperature, which is about 20° C. to 30° C. (step 68). In one embodiment, the annealing process may further include heating the gray iron component 12 to a temperature of about 800° C. to 900° C., and cooling the gray iron component 12 gradually to a temperature of about 500° C. to 650° C. The anneal process may be repeated one or more times. In another embodiment, the annealing and the quenching process may be repeated one or more times.

The disclosed methods may provide several advantages over conventional methods for improving strength and hardness of a material. For example, heat treatment of gray iron under an ultra-high magnetic field may facilitate phase transformation of gray iron. Specifically, equilibrium phase diagrams of ferrous alloys may be shifted when the ultra-high magnetic field is exerted, and phases and crystal structures that would have been previously impossible to obtain with conventional heat treatment processing, now may be obtained. The ultra-high magnetic field may promote the dislocation movement in the grain boundaries, and trapped energy at the grain boundaries may be dissipated, leading to an improved fatigue performance. Furthermore, using gray iron that has been heat-treated in an ultra-high magnetic field in an engine component may increase the performance and the life term of the engine component.

It will be apparent to those skilled in the art that various modifications and variations can be made to the disclosed method of improving mechanical properties of gray iron. Other embodiments will be apparent to those skilled in the art from consideration of the specification and practice of the disclosed method. It is intended that the specification and examples be considered as exemplary only, with a true scope being indicated by the following claims and their equivalents.

What is claimed is:

1. A method of forming gray iron components, the method comprising:

applying a substantially uniform magnetic field to gray iron comprising between 2.1% to 4.0% carbon; and heat-treating the gray iron while the gray iron is within the magnetic field to form a microstructure comprising pearlite having spacing of about 0.05 microns to 0.1 microns, wherein the heat-treating includes annealing and quenching and wherein the annealing includes:

(i) heating the gray iron to a first temperature of between about 800° C. to 900° C.; and (ii) cooling the gray iron to a second temperature of between about 500° C. to 650° C.

2. The method of claim 1, wherein the first temperature is about 900° C., and the second temperature is about 650° C.

3. The method of claim 1, wherein the steps (i) and (ii) are repeated at least once.

4. The method of claim 1, wherein the quenching includes:

cooling the gray iron to a third temperature of between about 20° C. to 30° C.

5. The method of claim 1, wherein the magnetic field has a density of between about 7 Tesla to about 30 Tesla.

6. The method of claim 1, wherein applying a substantially uniform magnetic field includes disposing the gray iron within a substantially uniform magnetic field generated by superconducting magnets.

7. A method for forming a gray iron component, the method comprising:

heating gray iron comprising between 2.1% to 4.0% carbon to a first temperature of between about 800° C. to 900° C.;

applying a substantially uniform magnetic field to the gray iron after the heating of the gray iron;

annealing the gray iron while the gray iron is within the magnetic field, wherein the annealing process includes cooling the gray iron to a second temperature of between about 500° C. to 650° C.; and quenching the gray iron while the gray iron is within the magnetic field to form a microstructure comprising pearlite having spacing of about 0.05 microns to 0.1 microns.

8. The method of claim 7, wherein the quenching includes cooling the gray iron to a third temperature of between about 20° C. to 30° C.

9. The method of claim 7, wherein the first temperature is about 900° C., and the second temperature is about 650° C.

10. The method of claim 7, wherein the annealing further includes reheating the gray iron after second temperature to the first temperature of between about 800° C. to 900° C., and cooling the gray iron to a temperature of between about 500° C. to 650° C.

11. The method of claim 10, wherein the annealing and quenching steps are repeated at least once.

12. The method of claim 7, wherein the magnetic field has a density of between about 7 Tesla to about 30 Tesla.

* * * * *